US005277652A

United States Patent [19]

Minor

[11] Patent Number: 5,277,652

[45] Date of Patent: Jan. 11, 1994

[54] SPRAY BOOTH

[76] Inventor: James G. Minor, 2560 Country Club Rd., Winston-Salem, N.C. 27104

[21] Appl. No.: 21,322

[22] Filed: Feb. 23, 1992

[51] Int. Cl.[5] ..... B05B 15/12

[52] U.S. Cl. ..... 454/52; 454/53

[58] Field of Search ..... 118/326, DIG.7; 454/50, 454/51, 52, 53, 54, 55

[56] References Cited

U.S. PATENT DOCUMENTS

| | | | |
|---|---|---|---|
| 4,237,780 | 12/1980 | Truhan | 454/52 |
| 5,127,574 | 7/1992 | Mosser et al. | 454/52 X |
| 5,133,246 | 7/1992 | Campbell | 454/52 |

FOREIGN PATENT DOCUMENTS

| | | | |
|---|---|---|---|
| 206257 | 7/1939 | Switzerland | 454/53 |
| 477749 | 7/1975 | U.S.S.R. | 118/326 |
| 691211 | 10/1979 | U.S.S.R. | 118/326 |
| 975111 | 11/1982 | U.S.S.R. | 118/326 |

*Primary Examiner*—Harold Joyce
*Attorney, Agent, or Firm*—Rhodes, Coats and Bennett

[57] ABSTRACT

A spray booth having a work area for an operator. A first fan assembly located in the back wall of the booth produces an exhaust air stream. Filter means are located between the first fan assembly and the work area. A second fan assembly supplies a make-up air stream and a laminar diffuser is connected to the second fan assembly and positioned above the operator to provide a downwardly directed air piston in the work area surrounding the operator In the preferred embodiment, the exhaust fan has a capacity of between about 340 and 400 CFM per foot width of the spray booth. In the preferred embodiment, the make-up air fan has a capacity of between about 230 and 300 CFM per foot width of the spray booth. Thus, in the preferred embodiment, the make-up air fan has a capacity of between about ⅔ and ¾ the capacity of the first fan assembly. Also, in the preferred embodiment, the laminar diffuser is located about 1 foot above the operator, is about 4 feet by 4 feet in area and produces a flow rate of between about 125 and 150 fpm. This amount is sufficient to provide a secure environment for the operator.

13 Claims, 2 Drawing Sheets

SPRAY BOOTH

BACKGROUND OF THE INVENTION (1) Field of the Invention

The present invention relates generally to environmental control systems and, more particularly, to a system for the control of volatile organic compounds ("VOC's") and other substances in a spray booth.

(2) Description of the Prior Art

Industry is becoming more sensitive to the effects of long-term exposure to VOC's. Recently, the Occupational Safety and Health Administration (OSHA) has amended the existing air contaminant standard to lower the permissible exposure limit (PEL) on over 400 substances and has added 164 substances not previously regulated. For example, among solvents, the PEL for Toluene was set at 100 parts per million (ppm) and the short-term exposure limit (STEL) was set at 150 ppm. Similar limits have been set for other solvents.

There are several engineering approaches to reducing PEL's. One is to improve ventilation by increasing the amount of fresh air being brought into an area. Good capture results can be achieved by using a large quantity of air to deal with a relatively small quantity of VOC's. Unfortunately, this is an expensive operation and not practical for most manufacturing situations. Another option is isolation. For example, walls, partitions and curtains may be designed to separate personnel from hazardous fumes.

Particularly troublesome are vapors emitted from paint and finish-spraying processes utilized, for example, in the automobile and furniture industry. The articles to be painted and finished are confined in a small, enclosed area and operators must spray numerous coats of various surface coverings over a short period of time. As these coatings are applied, vapors arise from the drying process and need to be evacuated from the working area as quickly as possible.

U.S. Pat. No 5,133,246, issued to Campbell, discloses a control system for controlling, capturing and disposal of VOC's and other substances that includes a spray booth having an entrance, an exit and an accessible working area in one or more areas adjacent to the working area which uses high velocity air currents to provide invadable spray booth sealing enclosures at the entrance, exit, working, and adjacent areas. An interior air flow supply means directs air generally in the direction of the article to be sprayed to move the floating particles of vapors and an air evacuation means recycles the supply air and removes the VOC's and other substances entrained therein to remote locations. However, the high velocities associated with an air curtain causes a vacuum near the air curtain nozzle which tends to infuse VOC's from the surrounding area and expose the personnel thereto.

U.S Pat. Nos. 4,237,780 and 5,127,574, issued to Truhan and Mosser et al., respectively, both disclose spray booths having vertical ventilation systems. However, these systems are high-velocity, high-CFM systems, which are expensive to manufacture and operate and which may disrupt the spray pattern from the spray gun.

Thus, there remains the need for a new and improved spray booth which requires significantly lower air flow than conventional systems while, at the same time, supplying superior control of VOC's in the area of the operator.

SUMMARY OF THE INVENTION

The present invention is directed to a spray booth having a work area for an operator. A first fan assembly located in the back wall of the booth produces an exhaust air stream. Filter means are located between the first fan assembly and the work area. A second fan assembly supplies a make-up air stream and a laminar diffuser is connected to the second fan assembly and positioned above the operator to provide a downwardly directed air piston in the work area surrounding the operator.

The first fan assembly includes an exhaust fan, an exhaust conduit and an exhaust outlet. In the preferred embodiment, the exhaust fan has a capacity of between about 340 and 400 CFM per foot width of the spray booth. The second fan assembly includes a make-up air inlet, a make-up air fan and a make-up air conduit. In the preferred embodiment, the make-up air fan has a capacity of between about 230 and 300 CFM per foot width of the spray booth. Thus, in the preferred embodiment, the make-up air fan has a capacity of between about $\frac{2}{3}$ and $\frac{3}{4}$ the capacity of the first fan assembly. Also, in the preferred embodiment, the laminar diffuser is located about 1 foot above the operator and is about 4 feet by 4 feet in area. The laminar diffuser produces a flow rate of between about 125 and 150 fpm. This amount is sufficient to provide a secure environment for the operator.

Accordingly, one aspect of the present invention is to provide a ventilation system for a spray booth having a top, bottom, and back wall defining a work area for an operator. The system includes: (a) a first fan assembly located in the back wall of the booth for producing an exhaust air stream; (b) a second fan assembly for supplying a make-up air stream; and (c) a laminar diffuser connected to the second fan assembly and positioned above the operator for providing a downwardly directed air piston in the work area surrounding the operator.

Another aspect of the present invention is to provide a ventilated spray booth. The booth includes: (a) a work area for an operator including top, bottom, and back walls; (b) a first fan assembly located in the back wall of the booth for producing an exhaust air stream; (c) filter means located between the first fan assembly and the work area; (d) a second fan assembly for supplying a make-up air stream; and (e) a laminar diffuser connected to the second fan assembly and positioned above the operator for providing a downwardly directed air piston in the work area surrounding the operator.

These and other aspects of the present invention will become apparent to those skilled in the art after a reading of the following description of the preferred embodiment when considered with the drawings.

DESCRIPTION OF THE PREFERRED EMBODIMENTS

Figure 1:
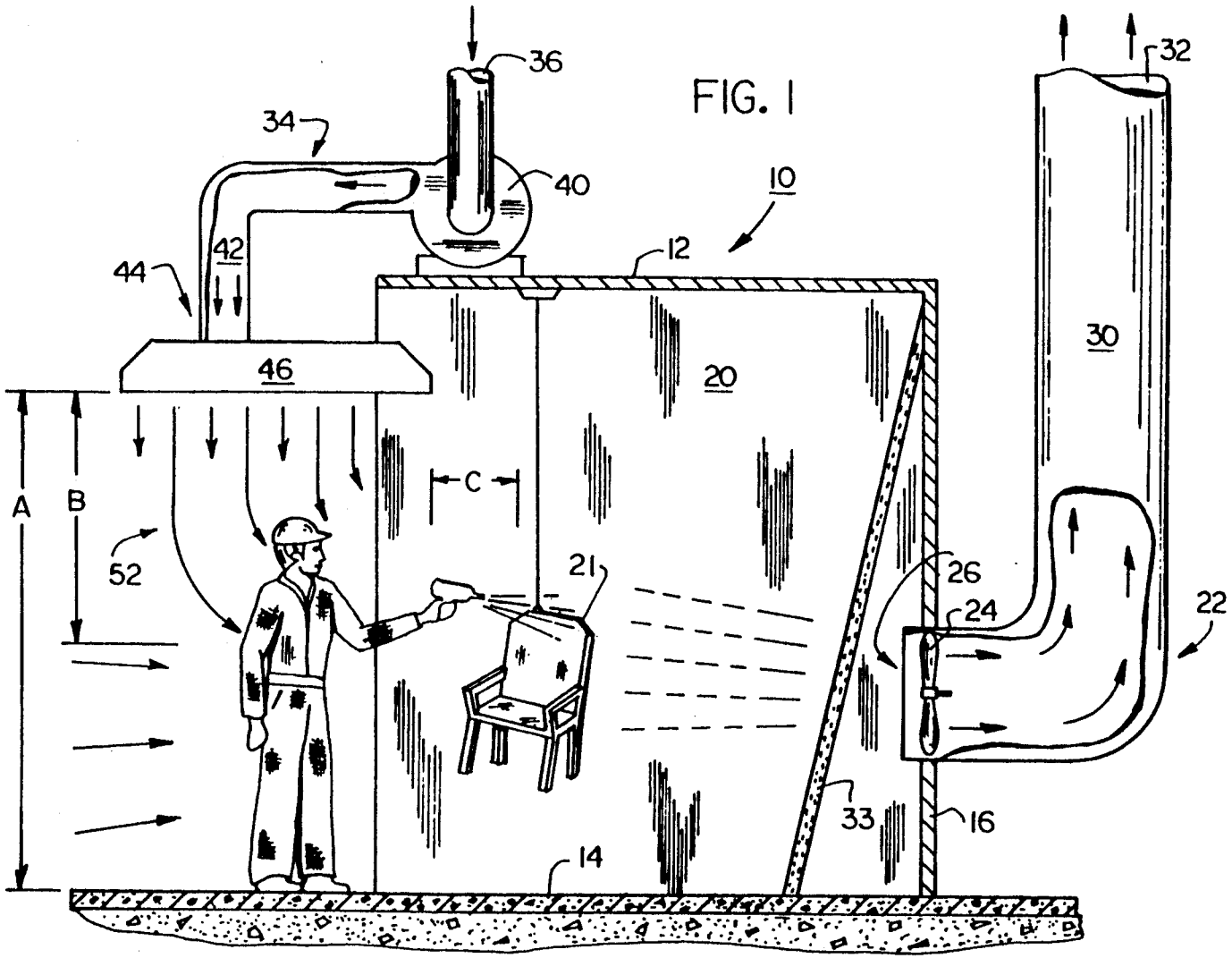
FIG. 1 is a schematic cross-sectional view of a spray booth constructed to the present invention.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, an environmentally controlled spray booth, generally designated 10, is shown constructed according to the present invention. The environmental control system for the spray booth includes 3 major subsystems: the spray booth itself, generally designated 10; the exhaust system generally designated 22; and the make-up clean air unit generally designated 34.

Spray booth 10 is conventional in design and includes a top 12, bottom 14, back wall 16 and, for fixed booths, side walls 20. The top, bottom, and back walls define a work space for supporting a work piece 21 to be painted or finished. The front of the spray booth 10 is generally open. Normally, a fixed-type spray booth is about 8 feet high, 8 feet wide, and 4–6 feet deep. However, the width of the spray booth may be up to 20 feet wide. Conveyor-type booths do not have actual sides but still have a defined work area for the operator.

The exhaust system 22 is conventional in design includes a first fan 24 having a capacity of 350–400 CFM per linear foot of the width of the spray booth. For example a 20 foot wide booth would use a 7000–8000 CFM fan. The fan 24 is located in duct inlet 26 which, in turn, is generally centered in back wall 16. However, in some systems the fan is remotely located from the booth. Duct 30 is connected between the duct inlet 26 and a duct outlet 32 where the VOC's gathered by the fan are either expelled or disposed of. A filter 33 is located in front of the fan intake. Several types of filters may be used but a water type has been acceptable.

Make-up clean air unit, generally designated 34, includes an air intake 36 connected to a second fan 40.

Fan 40 is sized at between about 230–300 CFM per foot width of the spray booth. For example, an 8 foot wide booth would use a fan of about 2000 CFM. The input of fan 40 flows through duct 42 to laminar diffuser assembly 44. One suitable laminar diffuser is available from M&W Industries, Inc. of Rural Hall, N.C. Laminar diffuser 44 includes a pair of elongated plenums located side-by-side. Each plenum is 2 feet×4 feet×8" high with the combined area of both plenums being a 4'×4' area. The bottom of the plenums 46 include a perforated bottom outlet 50 for emitting an air piston 52 to exit therefrom. The area of the air piston 52 is approximately that of the laminar diffuser (4'×4') and the velocity is approximately 125–150 feet per minute (less than about 2 miles per hour). Each 2'×4' diffuser plenum has a capacity of about 1000 CFM.

Air piston 52 has an inherent limited stability range. Accordingly, in the preferred embodiment, the bottom surface of the perforated bottom outlet 50 is mounted approximately 7 feet above the surface of bottom of spray booth 14. This height, as shown by Dimension "A", is sufficient to allow an operator to stand beneath laminar diffuser 44. At that height, air piston 52 extends about 3 feet as shown by Dimension "B". This provides sufficient coverage to protect the operator about the head and upper body from VOC's in the spray booth work area. Also, in the preferred embodiment, laminar diffuser 44 is spaced about 1 foot from work piece 21 as shown by Dimension "C". This distance insures that the operator remains within air piston 52 during the spraying operation.

Figure 2:
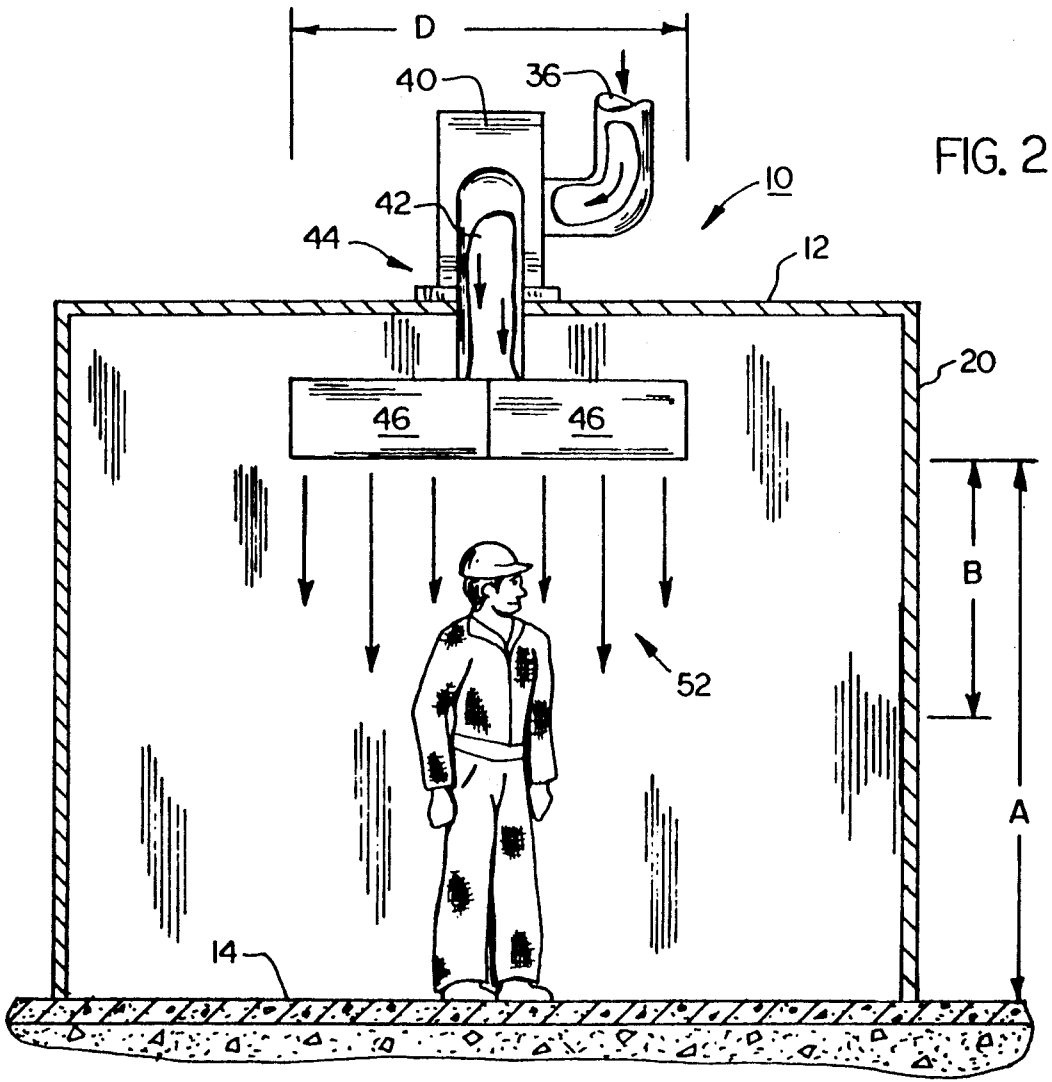
FIG. 2 is a front view of the spray booth shown in FIG. 1 taken along lines 2—2.

As best seen in FIG. 2, the 4 foot width of the laminar diffuser 44, as shown by Dimension "D", is sufficient to allow the operator a range of lateral movement without leaving the security of air piston 52.

In operation, exhaust fan 24 is operated at between 350–400 CFM per foot of linear width of the spray booth. For example, for an 8 foot wide booth, the CFM would be between about 2800–3200 CFM. The second fan 40 is operated at between 230–300 CFM per foot of width of the spray booth 10. For a 4'×4' laminar diffuser, the fan 40 has a capacity of about 2000 CFM producing a flow rate of 125–150 feet per minute. Accordingly, in the preferred embodiment, the output of the laminar diffuser is between $\frac{2}{3}$ and $\frac{3}{4}$ that of the exhaust fan 24 with the additional $\frac{1}{3}$ to $\frac{1}{4}$ of the air being made up by room air.

For comparison, a conventional exhaust system would be approximately 1300 CFM per foot of width of the spray booth. For example, a 20 foot wide booth would have a fan capacity of approximately 27,000 CFM. The present invention on the other hand, requires an exhaust fan capacity of only about 8000 CFM.

The advantages of the present invention will become more apparent upon reviewing the following detailed examples.

EXAMPLE NO. 1

A conventional spray booth was monitored for PPM concentrations around the worker and in the room around the spray booth. The booth was 6 feet high by 8 feet wide and 6 feet deep. A 24" exhaust fan located in the back wall of the spray booth produced an exhaust of about 4500 CFM or about 560 CFM per linear width of the booth. The operator began spraying in the booth. The VOC's were measured around the operator as 20 PPM. The background value was 5 PPM. The difference attributed to the spraying was 15 PPM.

EXAMPLE NO. 2

A spray booth constructed according to the present invention was monitored for PPM concentrations around the worker and in the room around the spray booth. The booth was 7 feet high by 8 feet wide and 8 feet deep. A 24" exhaust fan located in the back wall of the spray booth produced an exhaust of about 2700 CFM or about 340 CFM per linear width of the booth. Two 2'×4' laminar diffusers above the operator produced an air piston of about 2000 CFM at a velocity of between about 125–150 fpm. About 700 CFM ($\frac{1}{4}$ of exhaust) of room air was exhausted in addition to that supplied by the air piston. The operator began spraying in the booth. The VOC's were measured around the operator as 11 PPM. The background value was 5 PPM. The difference attributed to the spraying was 6 PPM.

EXAMPLE NO. 3

A spray booth constructed according to the present invention was estimated for PPM concentrations around the worker and in the room around the spray booth. The calculated booth was 7 feet high by 8 feet wide and 8 feet deep. A 24" exhaust fan located in the back wall of the spray booth produced an exhaust of about 3200 CFM or about 400 CFM per linear width of the booth. Two 2'×4' laminar diffusers above the operator would produce an air piston of about 2200 CFM at a velocity of between about 125–150 fpm. About 1000 CFM ($\frac{1}{3}$ of exhaust) of room air was expected to be exhausted in addition to that supplied by the air piston. The VOC's were calculated around the operator as 11 PPM. The background value was 5 PPM. The difference attributed to the spraying was 6 PPM.

From the above examples and calculations, it can be seen that the present invention requires an exhaust fan of between about 60 to 70% that of a conventional spray booth while, at the same time, significantly reducing the VOC exposure to the operator. For larger width spray booths, it is expected that the same 4'×4' size air piston could be used, resulting in more savings.

Certain modifications and improvements will occur to those skilled in the art upon a reading of the foregoing description. By way of example, the 2'×4' diffusers could be spaced apart to accommodate lights therebetween. Also, 4'×2' diffusers could be used where the depth of movement for the operator is not critical. It should be understood that all such modifications and improvements have been deleted herein for the sake of conciseness and readability but are properly within the scope of the following claims.

I claim:

1. A ventilation system for a spray booth having a top, bottom, and back walls defining a work area for an operator, said system comprising:

(a) a first fan assembly located in the back wall of the booth for producing an exhaust air stream;

(b) a second fan assembly for supplying a make-up air stream; and (c) a laminar diffuser connected to said second fan assembly and positioned above the operator for providing a downwardly directed air piston in the work area surrounding the operator.

2. The system according to claim 1, further including filter means located between said first fan assembly and said work area.

3. The system according to claim 1, wherein said first fan assembly includes an exhaust fan, an exhaust conduit and an exhaust outlet.

4. The system according to claim 3, wherein said exhaust fan has a capacity of between about 340 and 400 CFM per linear foot width of said spray booth.

5. A ventilated spray booth, said apparatus comprising:

(a) a work area for an operator including a top, bottom, and back walls;

(b) a first fan assembly located in the back wall of the booth for producing an exhaust air stream;

(c) filter means located between said first fan assembly and said work area;

(d) a second fan assembly for supplying a make-up air stream; and (e) a laminar diffuser connected to said second fan assembly and positioned above the operator for providing a downwardly directed air piston in the work area surrounding the operator.

6. The apparatus according to claim 5, wherein said first fan assembly includes an exhaust fan, an exhaust conduit and an exhaust outlet.

7. The apparatus according to claim 6, wherein said exhaust fan has a capacity of between about 340 and 400 CFM per foot width of said spray booth.

8. The apparatus according to claim 5, wherein said second fan assembly includes a make-up air inlet, a make-up air fan and a make-up air conduit.

9. The apparatus according to claim 8, wherein said make-up air fan has a capacity of between about 230 and 300 CFM per foot width of said spray booth.

10. The apparatus according to claim 8, wherein said make-up air fan has a capacity of between about $\frac{2}{3}$ and $\frac{3}{4}$ the capacity of said first fan assembly.

11. The apparatus according to claim 5, wherein said laminar diffuser is located about 1 foot above the operator.

12. The apparatus according to claim 5, wherein said laminar diffuser is about 4 feet by 4 feet in area.

13. The apparatus according to claim 5, wherein said laminar diffuser produces a flow rate of between about 125 and 150 fpm.

* * * * *